US011724173B2

(12) United States Patent
Rankin et al.

(10) Patent No.: US 11,724,173 B2
(45) Date of Patent: Aug. 15, 2023

(54) SYSTEM, METHOD, AND APPARATUS FOR PROVIDING AN IMMERSIVE EXPERIENCE FOR A SPORTS OR GAME SIMULATION USING A BALL

(71) Applicant: Golfinity, Inc., Austin, TX (US)

(72) Inventors: Marc Rankin, Austin, TX (US); Brian Webster, Anaheim, CA (US); Randy Pagnan, Anaheim, CA (US); John Brereton, Anaheim, CA (US); Mike Lautenslager, Elberta, AL (US)

(73) Assignee: SUPERMAX SIMULATION INC., Austin, TX (US)

( * ) Notice: Subject to any disclaimer, the term of this patent is extended or adjusted under 35 U.S.C. 154(b) by 193 days.

(21) Appl. No.: 17/148,788

(22) Filed: Jan. 14, 2021

(65) Prior Publication Data

US 2022/0219065 A1 Jul. 14, 2022

(51) Int. Cl.

| | |
|---|---|
| ***A63B 71/02*** | (2006.01) |
| ***A63B 71/06*** | (2006.01) |
| ***A63B 24/00*** | (2006.01) |

(52) U.S. Cl.

CPC ..... *A63B 71/0622* (2013.01); *A63B 24/0021* (2013.01); *A63B 71/022* (2013.01); *A63B 71/023* (2013.01); *A63B 2024/0034* (2013.01); *A63B 2071/0638* (2013.01); *A63B 2209/00* (2013.01); *A63B 2220/05* (2013.01); *A63B 2225/093* (2013.01)

(58) Field of Classification Search

CPC ..... A63B 71/0622; A63B 71/022; A63B 2071/0638; A63B 2220/05; A63B 2024/0028; A63B 63/00; A63B 69/36; A63B 2209/10

See application file for complete search history.

(56) References Cited

U.S. PATENT DOCUMENTS

| | | | | |
|---|---|---|---|---|
| 3,469,454 A | | 9/1969 | Cornell | |
| 3,591,184 A | | 7/1971 | Conklin et al. | |
| 3,895,809 A | | 7/1975 | Shockley | |
| 4,150,825 A | * | 4/1979 | Wilson | A63B 69/3658 473/152 |
| 4,373,720 A | | 2/1983 | Lombardi et al. | |

(Continued)

FOREIGN PATENT DOCUMENTS

| | | |
|---|---|---|
| WO | 2003022366 A2 | 3/2003 |
| WO | 2017141166 A1 | 8/2017 |

*Primary Examiner* — Seng H Lim

(74) *Attorney, Agent, or Firm* — Ellenoff Grossman & Schole LLP; John C. Stellabotte; Stephen L. Keefe

(57) ABSTRACT

A system for creating a virtual environment is disclosed. The system has a barrier screen configured to stop an object including a ball that is moved toward the barrier, including a first barrier screen portion that is a cylinder section, and a second barrier screen portion that is disposed above the first barrier screen portion, wherein the second barrier screen portion is an elliptical section. The system also has at least one projector configured to project an image of the virtual environment on the barrier screen, at least one sensor configured to sense data associated with the object, and a computing device configured to control the at least one projector to change the image based on the sensed data.

22 Claims, 14 Drawing Sheets

(56) References Cited

U.S. PATENT DOCUMENTS 4,437,672 A * 3/1984 Armantrout ..... A63B 24/0021 473/153
4,751,642 A * 6/1988 Silva ..... A63B 69/00 463/43
4,915,384 A * 4/1990 Bear ..... A63B 69/3614 473/154
5,779,241 A 7/1998 D'Costa et al.
5,798,519 A 8/1998 Vock et al.
5,882,204 A * 3/1999 Iannazo ..... A63B 24/0021 473/422
6,042,238 A * 3/2000 Blackham ..... H04N 9/3147 353/30
7,012,669 B2 * 3/2006 Streid ..... G03B 37/00 359/451
7,998,003 B2 8/2011 Orr
8,847,989 B1 * 9/2014 Berme ..... G06F 3/0346 345/633
9,126,093 B1 * 9/2015 Hagman ..... A63B 61/00
9,555,307 B1 1/2017 Lewis et al.
9,770,203 B1 * 9/2017 Berme ..... G01B 11/00
9,821,220 B2 * 11/2017 Gupta ..... A63F 9/24
9,916,011 B1 * 3/2018 Berme ..... G06F 3/011
10,058,733 B2 8/2018 Nicora
10,555,688 B1 * 2/2020 Berme ..... A61B 5/4848
10,860,843 B1 * 12/2020 Berme ..... G02B 27/0179
11,301,045 B1 * 4/2022 Berme ..... G06F 3/016
2004/0214648 A1 10/2004 Simpson
2009/0281450 A1 * 11/2009 Reichow ..... G09B 7/00 600/558
2010/0175330 A1 7/2010 Turcot
2014/0094326 A1 * 4/2014 Fuccillo ..... A63B 69/00 473/422
2014/0235374 A1 8/2014 Armell
2016/0158640 A1 * 6/2016 Gupta ..... G09B 9/006 463/3
2017/0113114 A1 4/2017 Nugent
2019/0299057 A1 * 10/2019 Vollbrecht ..... G06F 3/011

* cited by examiner

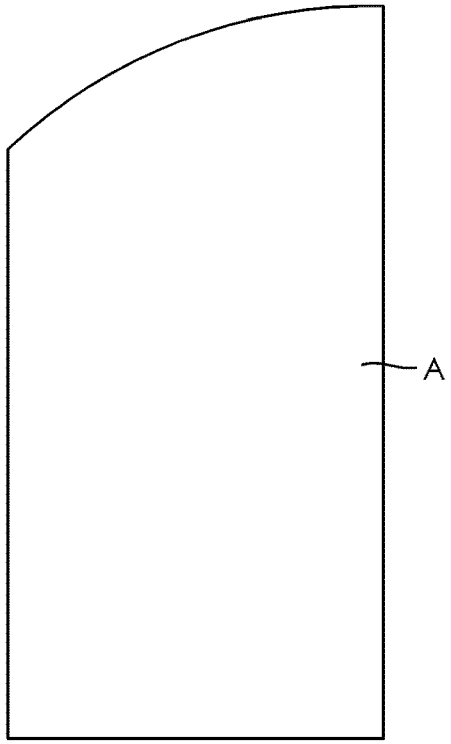
FIG. 10
FIG. 11A
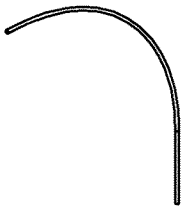
FIG. 11D
FIG. 11B
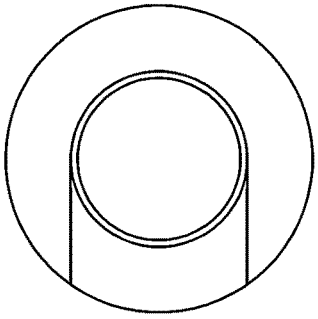
FIG. 11C
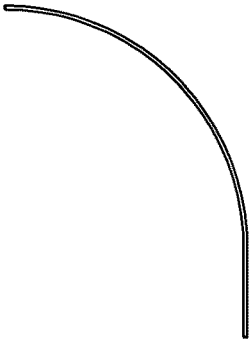
FIG. 11E FIG. 12A
FIG. 12B
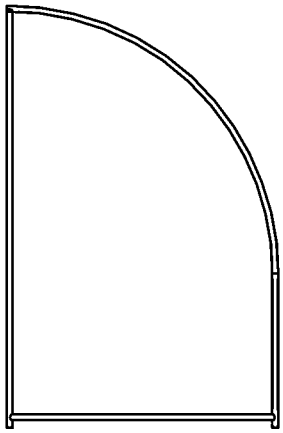
FIG. 12C
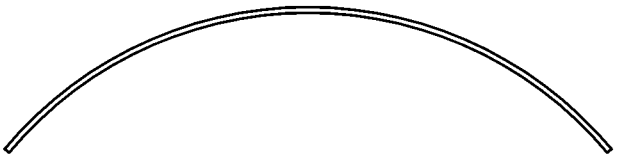
FIG. 13A
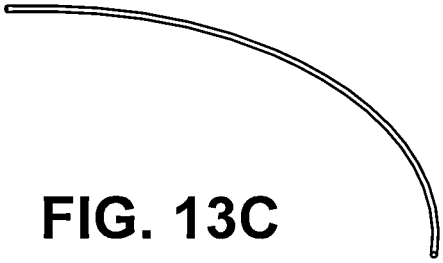
FIG. 13C
FIG. 13B
FIG. 13D

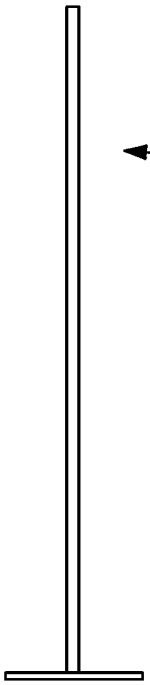
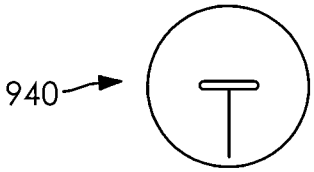
FIG. 19B
FIG. 19A
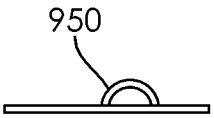
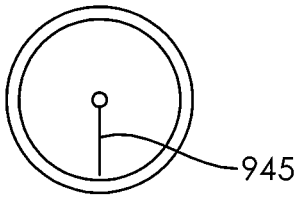
FIG. 19C
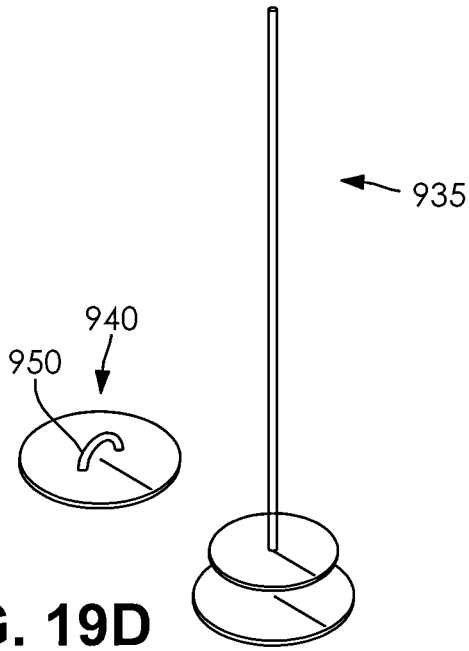
FIG. 19D

SYSTEM, METHOD, AND APPARATUS FOR PROVIDING AN IMMERSIVE EXPERIENCE FOR A SPORTS OR GAME SIMULATION USING A BALL

TECHNICAL FIELD

The present disclosure is directed to a system, method, and apparatus for providing an experience, and more particularly, to a system, method, and apparatus for providing an immersive experience for a sports or game simulation using a ball.

BACKGROUND OF THE DISCLOSURE

Some conventional systems for providing simulations for athletic training and enhancing athletic performance involve projecting virtual environments on screens to provide a degree of realism to the training environment. For example, some conventional systems for improving a golf swing include a flat screen or boundary that is disposed in front of a training tee for a golfer and displays a virtual golf course. For example, projected images of real pictures of a golf course or videos or computer-simulated images of a golf course are displayed on a flat screen in front of the golfer to provide a degree of realism to the golf training.

Such conventional systems typically do not provide a realistic experience for the training athlete because the user can see where the horizontal screen ends in his or her peripheral vision and can easily perceive that the display is horizontal when looking to the side portions of the display. Accordingly, such conventional systems do not provide an immersive effect and experience for a user such as a training athlete.

U.S. Pat. No. 3,591,184 to Conklin (the '184 patent) discloses one conventional system for an indoor golf game. The '184 patent discloses a target including sensors that detect data indicating a flight trajectory of a golf ball hit at the target. As best understood, the '184 patent includes a substantially flat screen for projecting images, which is supported at a front portion of the target. Accordingly, the '184 patent does not provide an immersive effect for a user viewing the apparently flat screen of disposed in front of the target.

U.S. Pat. No. 4,150,825 to Wilson (the '825 patent) discloses a golf game simulating apparatus having a screen 20 configured to cause a driven golf ball to deflect generally downwardly at a speed considerably less than the speed at which the ball strikes the screen. The system of the '825 patent apparently utilizes the rebound angle of the ball to help calculate an amount of hook or slice of the golfer using the system. However, the '825 patent does not provide an immersive effect for the user.

The exemplary disclosed system, method, and apparatus of the present disclosure is directed to overcoming one or more of the shortcomings set forth above and/or other deficiencies in existing technology.

SUMMARY OF THE DISCLOSURE

In one exemplary aspect, the present disclosure is directed to a system for creating a virtual environment. The system includes a barrier screen configured to stop an object including a ball that is moved toward the barrier, including a first barrier screen portion that is a cylinder section, and a second barrier screen portion that is disposed above the first barrier screen portion, wherein the second barrier screen portion is an elliptical section. The system also includes at least one projector configured to project an image of the virtual environment on the barrier screen, at least one sensor configured to sense data associated with the object, and a computing device configured to control the at least one projector to change the image based on the sensed data.

In another aspect, the present disclosure is directed to a method. The method includes assembling a barrier screen having a first barrier screen portion and a second barrier screen portion that is disposed above the first barrier screen portion, assembling the first barrier screen portion as a cylindrical section, and assembling the second barrier screen portion as an elliptical section. The method also includes stopping an object including a ball that is propelled toward the barrier screen with a surface of the barrier screen, sensing data associated with the object that is propelled, and projecting an image on the surface of the barrier screen showing a continued virtual path of the object based on the sensed data.

BRIEF DESCRIPTION OF THE DRAWINGS

Accompanying this written specification is a collection of drawings of exemplary embodiments of the present disclosure. One of ordinary skill in the art would appreciate that these are merely exemplary embodiments, and additional and alternative embodiments may exist and are still within the spirit of the disclosure as described herein.

FIG. 10 illustrates a schematic view of at least some exemplary embodiments of the present disclosure;

FIG. 11A illustrates a top view of at least some exemplary embodiments of the present disclosure;

FIG. 11B illustrates a side view of at least some exemplary embodiments of the present disclosure;

FIG. 11C illustrates a side view of at least some exemplary embodiments of the present disclosure;

FIG. 11D illustrates a side view of at least some exemplary embodiments of the present disclosure;

FIG. 11E illustrates a side view of at least some exemplary embodiments of the present disclosure;

FIG. 12A illustrates a top view of at least some exemplary embodiments of the present disclosure;

FIG. 12B illustrates a side view of at least some exemplary embodiments of the present disclosure;

FIG. 12C illustrates a side view of at least some exemplary embodiments of the present disclosure;

FIG. 13A illustrates a side view of at least some exemplary embodiments of the present disclosure;

FIG. 13B illustrates a top view of at least some exemplary embodiments of the present disclosure;

FIG. 13C illustrates a side view of at least some exemplary embodiments of the present disclosure;

FIG. 13D illustrates a side view of at least some exemplary embodiments of the present disclosure;

FIG. 19A illustrates a side view of at least some exemplary embodiments of the present disclosure;

FIG. 19B illustrates a plan view of at least some exemplary embodiments of the present disclosure;

FIG. 19C illustrates a plan view of at least some exemplary embodiments of the present disclosure;

FIG. 19D illustrates a perspective view of at least some exemplary embodiments of the present disclosure;

DETAILED DESCRIPTION AND INDUSTRIAL APPLICABILITY

Figure 1:
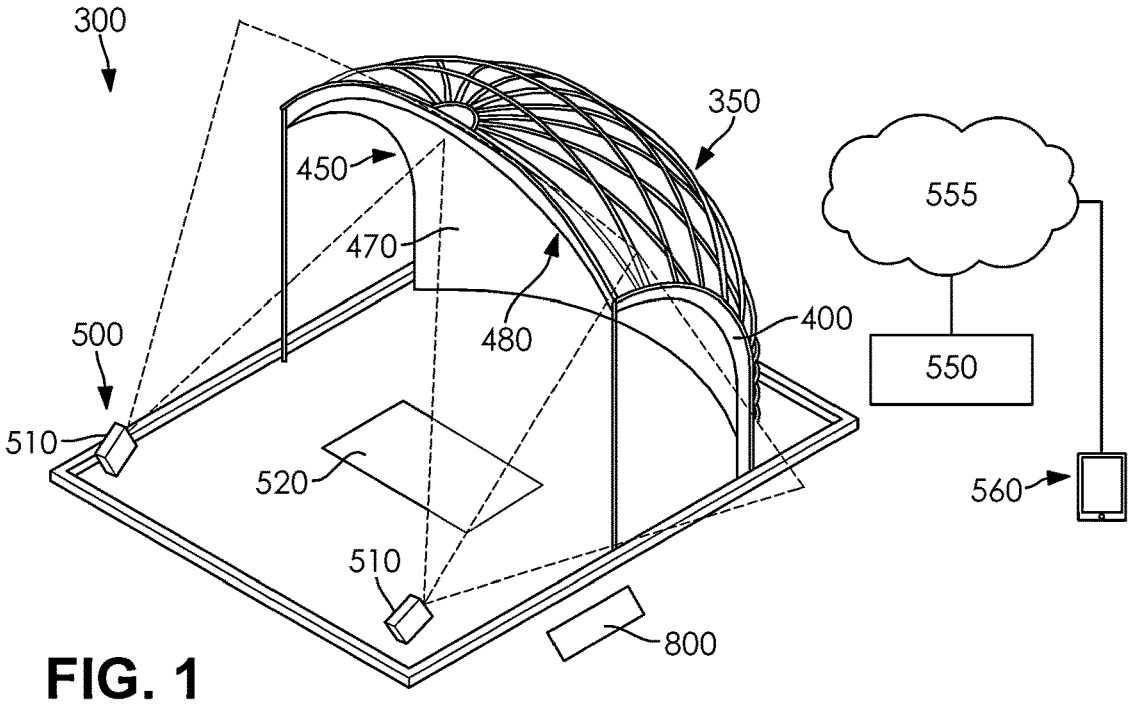
FIG. 1 illustrates a perspective view of at least some exemplary embodiments of the present disclosure.

In at least some exemplary embodiments, the exemplary disclosed system, method, and apparatus may include a structure such as a dome structure (e.g., SuperMax Dome) for projecting an image to be used in a training activity such as physical, athletic, and/or sports training. The exemplary disclosed system, method, and apparatus may be used in training for athletic sports such as golf, baseball, football, skee ball, bowling, soccer, kickball, dodgeball, tennis, or any other suitable sport.

FIGS. 1-5 illustrate an exemplary embodiment of the exemplary disclosed system, method, and apparatus. System 300 may include a structural assembly 350, a flexible assembly 400, an impact assembly 450, an imaging system 500, and a computing system 550. Structural assembly 350 may support flexible assembly 400 and impact assembly 450. Structural assembly 350, flexible assembly 400, and impact assembly 450 may form a barrier screen for stopping an object that may be moved toward the barrier screen. Imaging system 500 may provide an image on a surface of impact assembly 450. Computing system 550 may control system 300 including the image provided by imaging system 500.

Structural assembly 350 may be any suitable structural assembly for supporting flexible assembly 400 and impact assembly 450. Structural assembly 350 may include a plurality of members (e.g., tubes, channels, I-beams, and/or any other suitable structural members), hardware such as fasteners, connectors, brackets, and/or any other suitable structural components. Structural assembly 350 may be a modular assembly that may be assembled and disassembled as desired. Structural assembly 350 may be formed from any suitable structural material such as, for example, metal, plastic, composite material, hybrid material, wood, and/or any other suitable structural material. For example, structural assembly 350 may be formed from structural steel or structural aluminum material. In at least some exemplary embodiments, structural assembly 350 may be a modular assembly including structural steel tubing. As illustrated in FIGS. 1-4, a plurality of members of structural assembly 350 may be attached (e.g., removably attached) to form a structural shell for supporting flexible assembly 400 and impact assembly 450. For example, structural assembly 350 may include a plurality of structural members that are fastened together to form a grid structure (e.g., a frame or truss) for supporting flexible assembly 400 and impact assembly 450. For example, structural assembly 350 may form a hard shell structure for supporting impact assembly 450 and flexible assembly 400.

Figure 2:
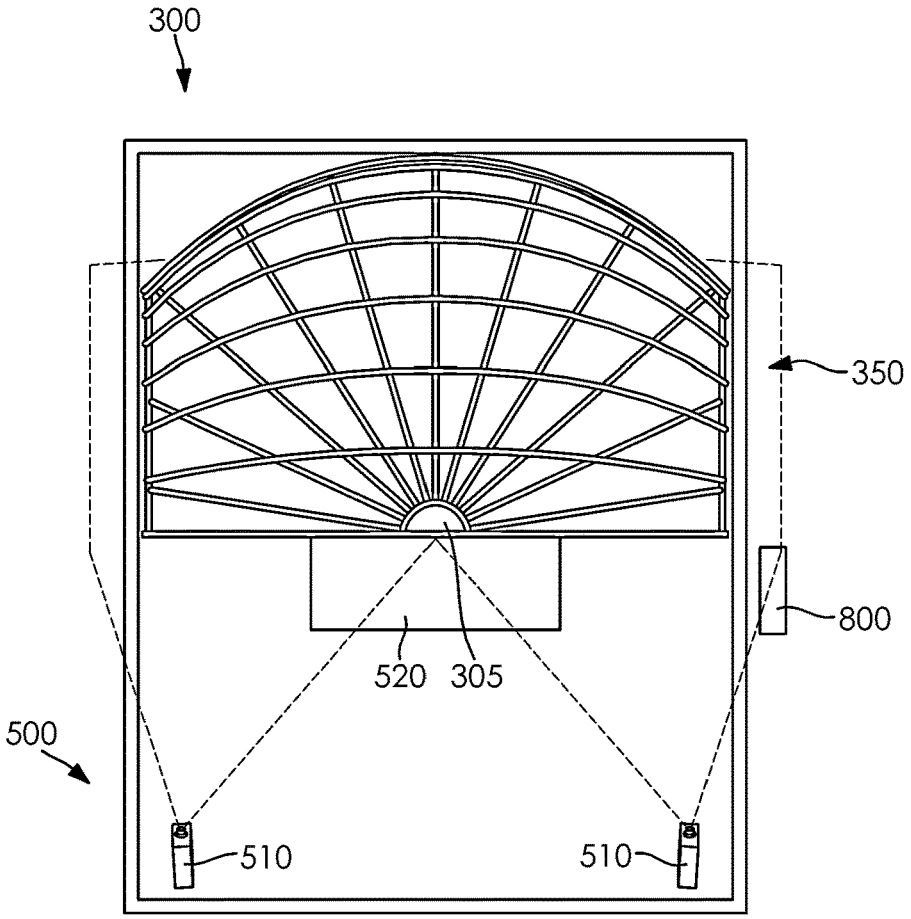
FIG. 2 illustrates a top view of at least some exemplary embodiments of the present disclosure.
Figure 4:
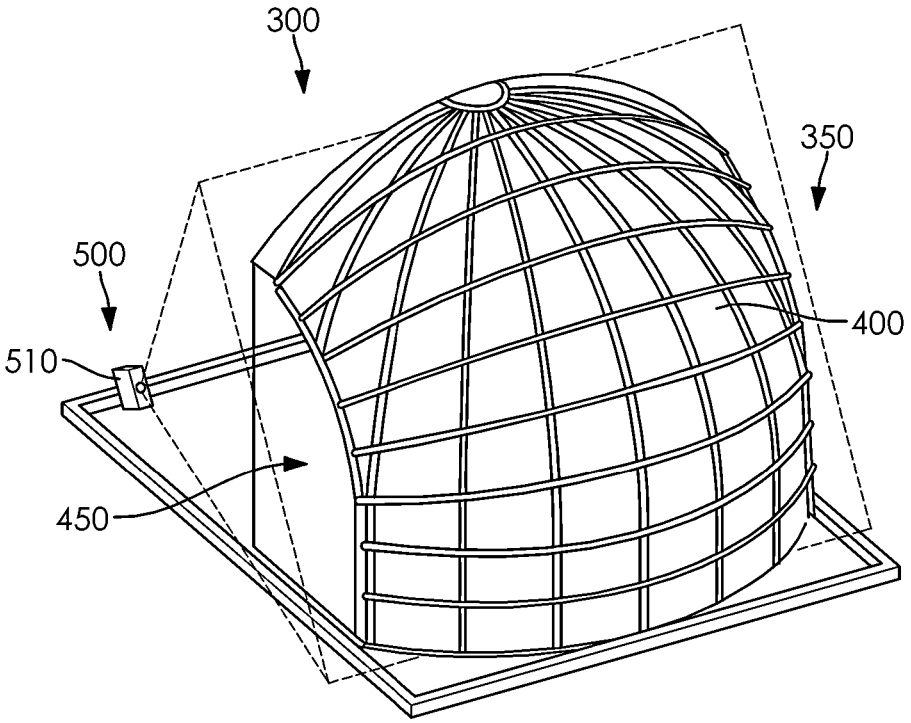
FIG. 4 illustrates a perspective view of at least some exemplary embodiments of the present disclosure.
Figure 6:
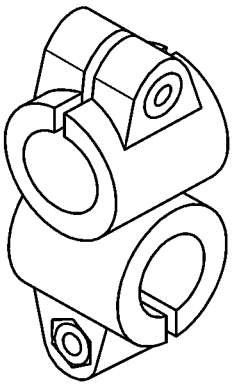
FIG. 6 illustrates a perspective view of at least some exemplary embodiments of the present disclosure.
Figure 7:
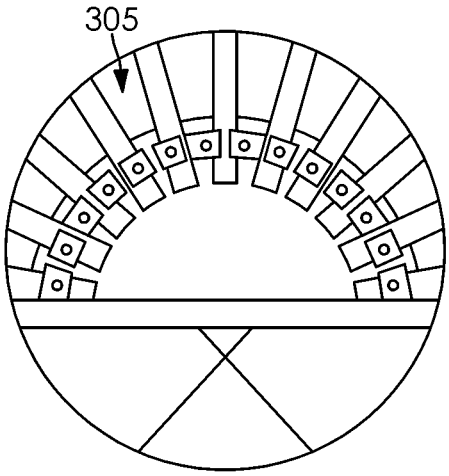
FIG. 7 illustrates a top view of at least some exemplary embodiments of the present disclosure.

In at least some exemplary embodiments and as illustrated in FIG. 1, structural assembly 350 may be a geodesic support structure and may include one or more front arch supports. In at least some exemplary embodiments and as illustrated in FIG. 4, structural assembly 350 may include rib and spine members that may be cut and/or curved to form any desired shape for supporting flexible assembly 400 and impact assembly 450 for example as described herein. Structural assembly 350 may include any suitable connectors such as swivel connectors (e.g., tube swivel connectors) for example as illustrated in FIG. 6. Structural assembly 350 may include a bracket 305 (e.g., corner stone bracket) for connecting structural members for example as illustrated in FIGS. 2 and 7. Structural assembly 350 may include members provided in any suitable configuration (e.g., as illustrated in FIGS. 11A through 11E, 12A through 12C, and 13A through 13D) for forming any desired shape of structural assembly 350 for supporting flexible assembly 400 and impact assembly 450.

Structural assembly 350 may be formed to provide a structure having any desired curvature. For example, structural assembly 350 may have horizontal curvature and/or vertical curvature to form a curved shell structure. For example, structural assembly 350 may be horizontally curved (e.g., have horizontal curvature) about a substantially vertical axis and/or vertically curved (e.g., have vertical curvature) about a substantially horizontal axis. Structural assembly 350 may also include curvature about any desired axis (e.g., an axis disposed diagonally and/or in any desired direction). Portions of structural assembly 350 may be horizontally curved, vertically curved, and/or both horizontally and vertically curved.

Figure 3:
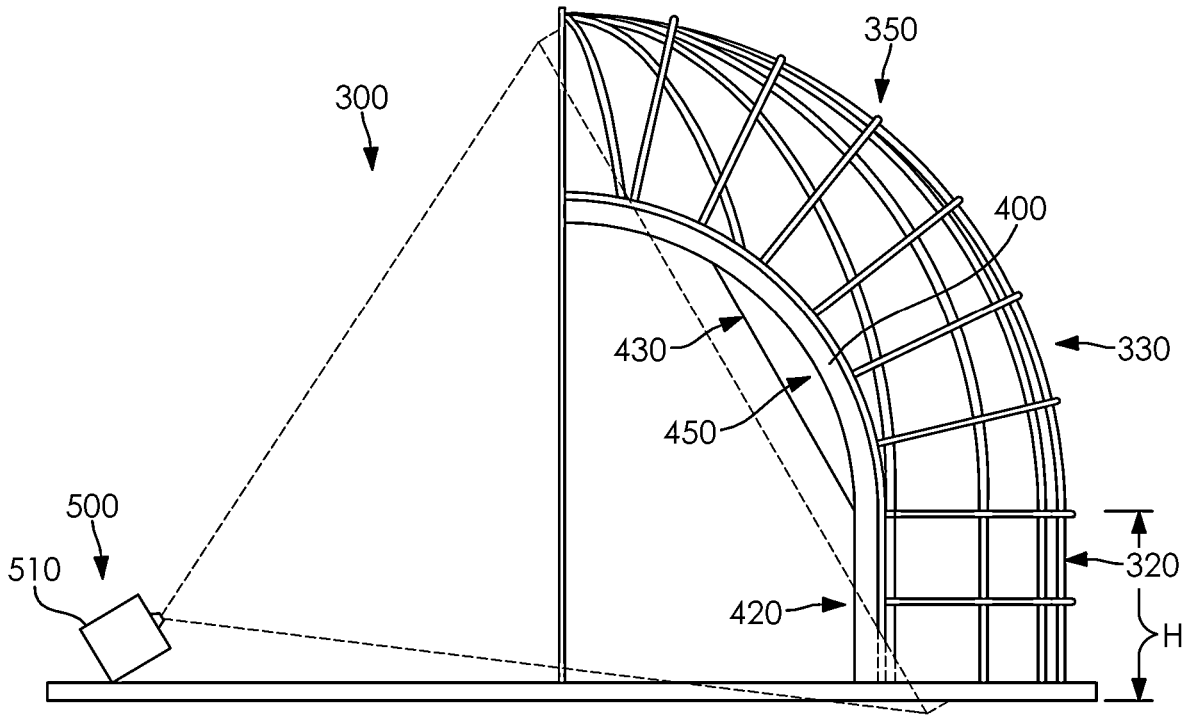
FIG. 3 illustrates a side view of at least some exemplary embodiments of the present disclosure.
Figure 8:
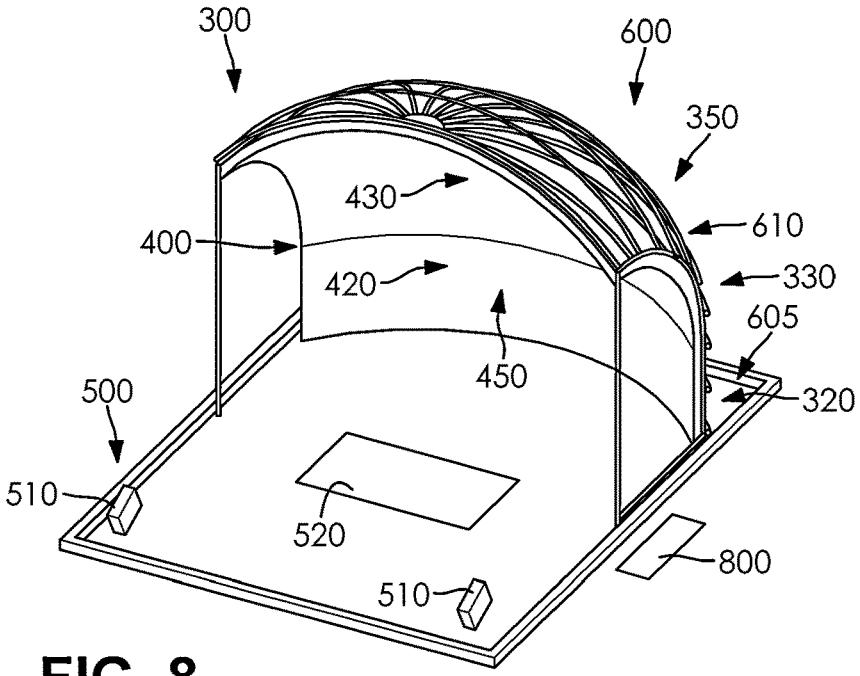
FIG. 8 illustrates a perspective view of at least some exemplary embodiments of the present disclosure.

In at least some exemplary embodiments and as illustrated in FIGS. 3 and 8, a lower portion 320 of structural assembly 350 may include horizontal curvature. For example, lower portion 320 may be horizontally curved to form a cylinder shape. Lower portion 320 may extend any desired height "H" above a bottom (e.g., ground surface) of structural assembly 350 as illustrated in FIG. 3. For example, lower portion 320 may extend height "H" that may be 60 inches (or any other desired distance such as between 0 and about 10 feet, between about 1 foot and about 20 feet, between about 3 feet and about 12 feet, between about 4 feet and about 8 feet, or between about 4 feet and about 6 feet). For example, lower portion 320 may be between about four feet high and about six feet high. Lower portion 320 may thereby provide an offset portion of structural assembly 350 having horizontal curvature and not vertical curvature. Structural assembly 350 may also include an upper portion 330 having both horizontal and vertical curvature. Upper portion 330 may form for example a dome portion (e.g., having an elliptical dome shape or a spherical dome shape). Structural assembly 350 may for example include upper portion 330 that may be a dome portion (e.g., having both horizontal curvature and vertical curvature) disposed on lower portion 320 that may be a cylindrical portion (e.g., having horizontal curvature and not vertical curvature). Upper portion 330 (e.g., and lower portion 320) may have any desired radius of curvature such as, for example, a 12.5 foot radius of curvature (e.g., and/or any other desired radius of curvature such as, for example, between about 6 feet and about 20 feet, or between about 10 feet and about 15 feet). For example, upper portion 330 may form a spherical or elliptical shell structure. Upper portion 330 may have any desired amount of vertical curvature. For example, upper portion 330 may have vertical curvature of between about 10 degrees and about 90 degrees, between about 30 degrees and about 90 degrees, between about 45 degrees and about 90 degrees, or between about 75 degrees and about 90 degrees.

Flexible assembly 400 may be formed from a flexible material. For example, flexible assembly 400 may be formed from an elastic material. In at least some exemplary embodiments, flexible assembly 400 may be formed from compressible material. Flexible assembly 400 may be formed from foam material. For example, flexible assembly 400 may be formed from closed cell foam material. Flexible assembly 400 may be formed from polyurethane foam (e.g., flexible polyurethane foam) material. Flexible assembly 400 may be formed from elastomeric material. Flexible assembly 400 may be formed from relatively light and non-dense material. For example, flexible assembly 400 may be formed from uncompressed material. In at least some exemplary embodiments, flexible assembly 400 may be formed from uncompressed, light foam material.

Flexible assembly 400 may have any suitable thickness for compressing to absorb kinetic energy of a moving object such as a ball (e.g., by compressing to transfer the kinetic energy of the ball into potential energy to be stored in the compressed material of flexible assembly 400). For example, flexible assembly 400 may have any suitable thickness for stopping a moving object that impacts flexible assembly 400 so that the object falls to the ground. In at least some exemplary embodiments, flexible assembly 400 may have a thickness of between about 3 inches and about 24 inches, between about 6 inches and about 20 inches, between about 6 inches and about 18 inches, or between about 12 inches and about 18 inches (e.g., or any other suitable thickness). In at least some exemplary embodiments, flexible assembly 400 may be a foam layer having a thickness of about 12 inches. In at least some exemplary embodiments, flexible assembly 400 may be a foam layer having a thickness of between about 6 inches thick and about 18 inches thick.

Flexible assembly 400 may be configured similarly to structural assembly 350. Flexible assembly 400 may include curvature (e.g., horizontal and/or vertical curvature) similar to structural assembly 350 so that flexible assembly 400 may be received by and abut against surfaces of structural assembly 350. For example, flexible assembly 400 and structural assembly 350 may have a similar shape, curvature, and configuration so that flexible assembly 400 may be nested within structural assembly 350. As illustrated in FIGS. 3 and 8, flexible assembly 400 may include a lower portion 420, which may have a curvature similar to lower portion 320 for example as described above. Flexible assembly 400 may include an upper portion 430, which may have a curvature similar to upper portion 330 for example as described above. Flexible assembly 400 may for example include upper portion 430 that may be a dome portion (e.g., having both horizontal curvature and vertical curvature) disposed on lower portion 420 that may be a cylindrical portion (e.g., having horizontal curvature and not vertical curvature). Flexible assembly 400 may be nested within structural assembly 350 based for example on lower portion 420 being nested within lower portion 320 and upper portion 430 being nested within upper portion 330 for example as illustrated in FIGS. 1, 3, 4, and 8.

Impact assembly 450 may be any suitable assembly for forming a layer having a surface that may be impacted by a moving object such as a ball. For example, impact assembly 450 may be an impact screen. Impact assembly 450 may form a tarp that may be suspended from structural assembly 350. Impact assembly 450 may be formed from flexible material such as fabric material. Impact assembly 450 may be formed from textile material. In at least some exemplary embodiments, impact assembly 450 may be a coated high strength textile material. Impact assembly 450 may include PVC, nylon, and/or polyester material.

Figure 17A:
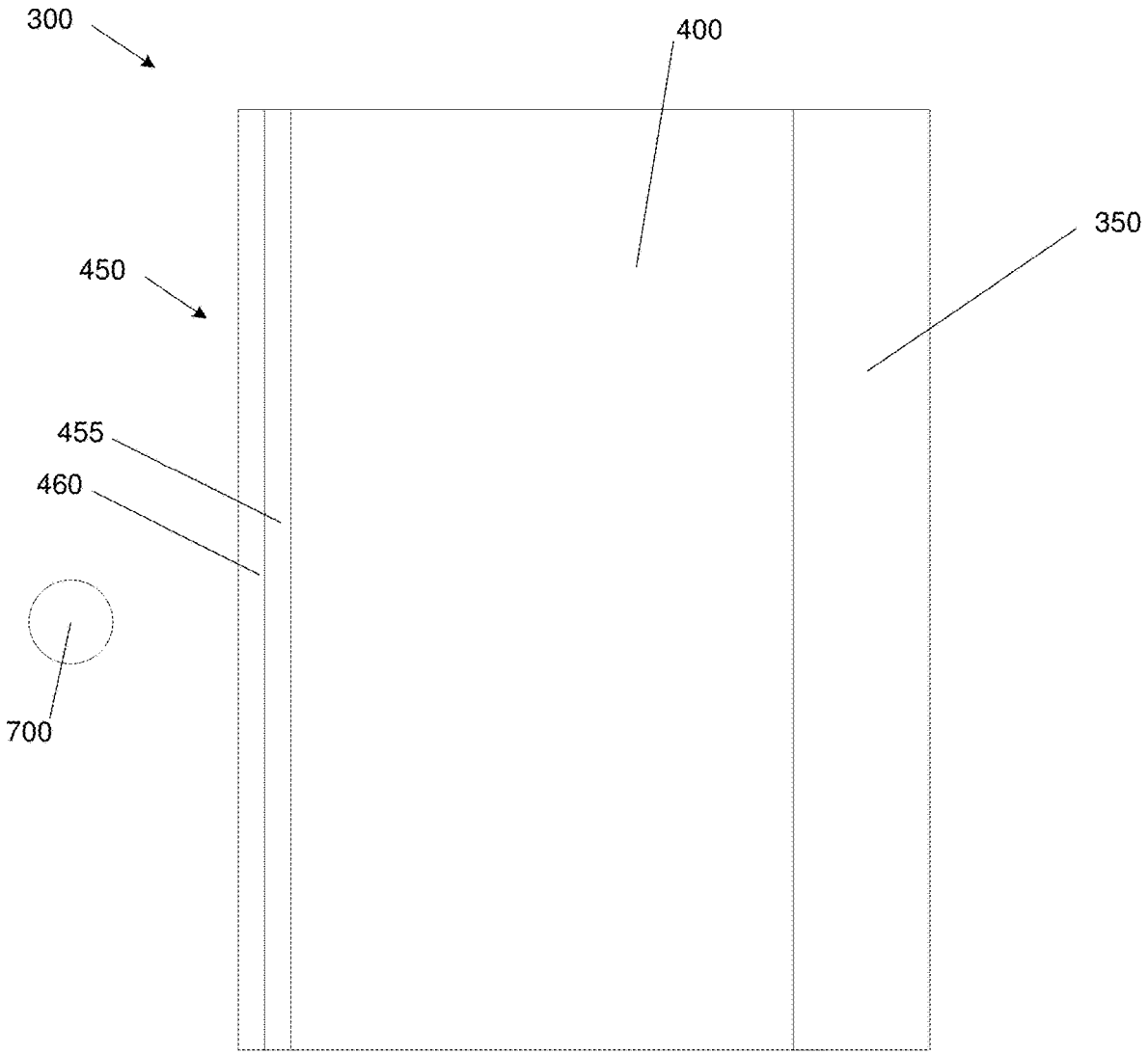
FIG. 17A illustrates a sectional view of at least some exemplary embodiments of the present disclosure.

Impact assembly 450 may have a relatively small thickness of for example between about 1/16" and 1/4". In at least some exemplary embodiments, impact assembly may be about 1/8" thick (e.g., about 3 mm). Impact assembly 450 may include a plurality of layers of the exemplary disclosed material. For example as illustrated in FIG. 17A, impact assembly 450 may include a layer 455 and a layer 460 that may be formed from the exemplary disclosed material. A combined thickness of layers 455 and 460 may have a thickness as described above, or each of layers 455 and 460 may have a thickness as described above. In at least some exemplary embodiments, a spacer material (e.g., a spacer cushion such as a nylon spacer cushion) may be disposed between layers 455 and 460.

Layer 460 may for example be a sacrificial layer that may be disposed on layer 455 that may be a base layer. For example during use of system 300, objects impacting impact assembly 450 may strike and wear away portions of layer 460 (e.g., exterior layer that may be a sacrificial layer). After some or substantially all of layer 460 (e.g., sacrificial layer) has been worn away, layer 460 may be replaced with a new layer 460. Because layer 460 (e.g., sacrificial layer) may be disposed on top of and thereby protect layer 455 (e.g., base layer), layer 460 may be replaced while layer 455 may be maintained (e.g., because layer 460 may protect layer 455 from being worn away). Multiple layers 460 (e.g., sacrificial layers) may be iteratively removed and replaced in succession over time during use of system 300.

Figure 17B:
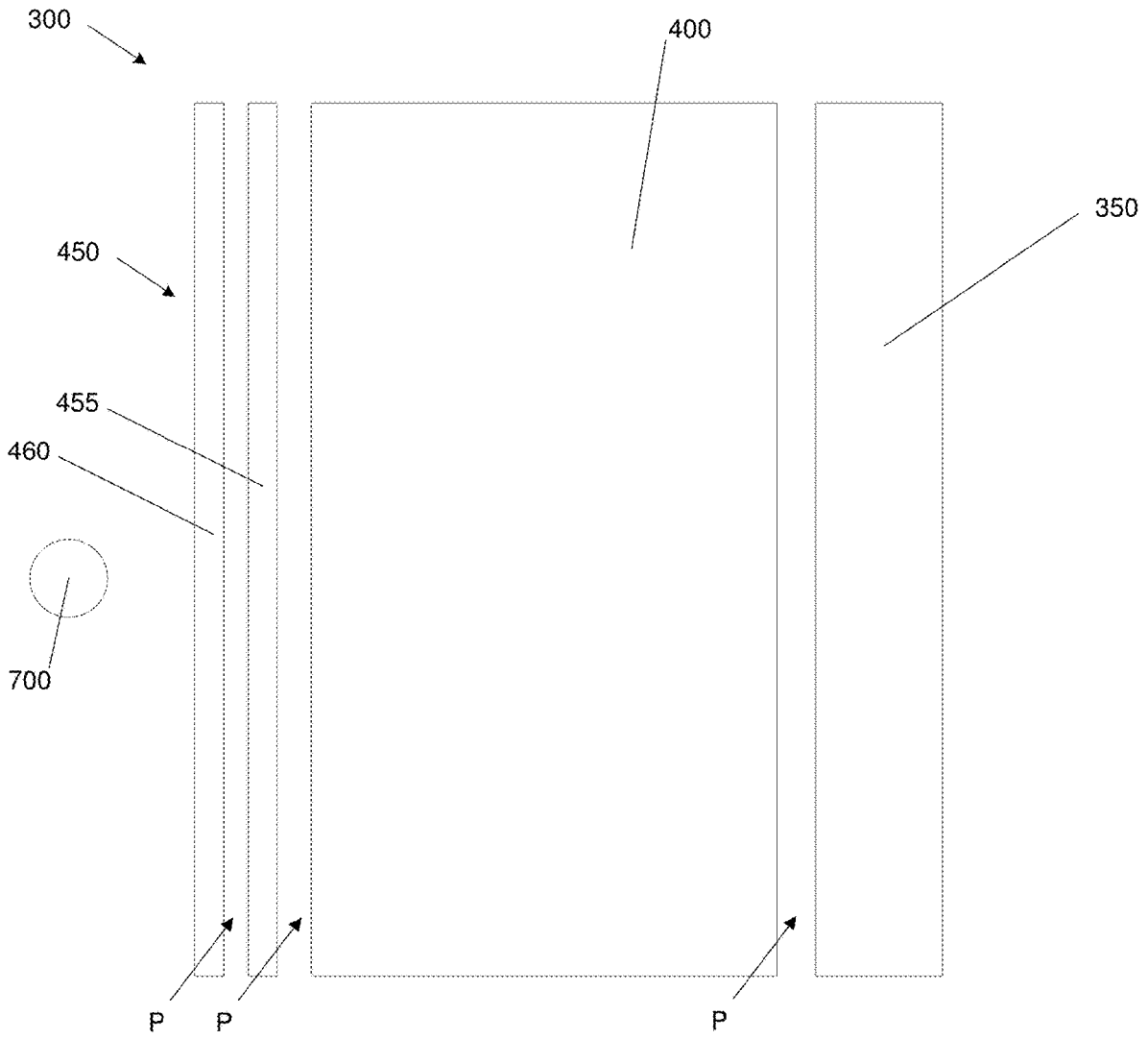
FIG. 17B illustrates a sectional view of at least some exemplary embodiments of the present disclosure.

FIG. 17B illustrates another exemplary embodiment of system 300. A layer of air "P" (e.g., an air pocket) may be disposed between layer 455 and 460, between layer 455 and flexible assembly 400, and/or between flexible assembly 400 and structural assembly 350. Each layer of air P may be any desired width such as, for example, between about 1/16 inch and about 3 inches, between about 1/16 inch and 1 inch, or between about 1/8 inch and 3/4 inch.

As illustrated in FIGS. 15A, 15B, 15C, and 15D, impact assembly 450 may be configured similarly to flexible assembly 400 and structural assembly 350. Impact assembly 450 may include curvature (e.g., horizontal and/or vertical curvature) similar to flexible assembly 400 and structural assembly 350 so that impact assembly 450 may be received by and fit within contours of flexible assembly 400. For example, impact assembly 450, flexible assembly 400, and structural assembly 350 may have a similar shape, curvature, and configuration so that impact assembly 450 may be nested within flexible assembly 400, and flexible assembly 400 may be nested within structural assembly 350. Impact assembly 450 may include a lower portion 470, which may have a curvature similar to lower portion 320 for example as described above and/or lower portion 420. Impact assembly 450 may include an upper portion 480, which may have a curvature similar to upper portion 330 for example as described above and/or upper portion 430. Impact assembly 450 may for example include upper portion 480 that may be a dome portion (e.g., having both horizontal curvature and vertical curvature) disposed on lower portion 470 that may be a cylindrical portion (e.g., having horizontal curvature and not vertical curvature). Impact assembly 450 may be received within flexible assembly 400 based for example on lower portion 470 being nested within lower portion 420 and upper portion 480 being nested within upper portion 430 for example as illustrated in FIGS. 1 and 15A through 15D.

As illustrated in FIGS. 15A, 15B, 15C, and 15D, impact assembly 450 including lower portion 470 and upper portion 480 may be formed from a plurality of panels that may be cut, configured, and attached to provide the exemplary disclosed shape and curvature. The plurality of panels may for example form a float screen that may be suspended from structural assembly 350. Impact assembly 450 may be custom fabricated in any desired configuration for example as illustrated in FIGS. 15A, 15B, 15C, and 15D.

As illustrated in FIGS. 8 and 17A (e.g., and FIG. 17B), flexible assembly 400 may be disposed between structural assembly 350 and impact assembly 450. Impact assembly 450 may be free hanging (e.g., a free hanging fabric screen) from structural assembly 350. In at least some exemplary embodiments, impact assembly 450 may include an attachment section extending along partial sections of a perimeter or a substantially entire perimeter of impact assembly 450. The attachment section may include fastener components such as grommets, hook and loop fasteners (e.g., VELCRO®), wire connectors (e.g., nylon draw strings), and/or any other suitable fasteners for attaching impact assembly 450 to the exemplary disclosed members of structural assembly 350. Flexible assembly 400 may be supported by impact assembly 450, which may be attached to structural assembly 350 via the exemplary disclosed attachment portions. For example, impact assembly 450 may be attached in a freely-hanging configuration to structural assembly 350, with flexible assembly 400 disposed and supported between impact assembly 450 and structural assembly 350 via the freely-hanging attachment. Layers 455 and 460 of impact assembly 450 may be each attached to structural assembly 350 via the exemplary disclosed attachment portion. Layer 460 (e.g., sacrificial layer) may be removed and replaced from the exemplary disclosed attachment portion as desired. For example, layer 460 (e.g., sacrificial layer) may include grommets or other fastener components around its perimeter that may be removed from fasteners maintaining layer 455 (e.g., base layer) on structural assembly 350. A new layer 460 may then be removably attached to structural member 350 to cover layer 455. Depending on the activity (e.g., sport) to be trained using the exemplary disclosed system, impact assembly 450 and/or flexible assembly 400 may include apertures, recesses, protrusions and/or any other suitable attachments or components for integrating suitable equipment (e.g., for baseball, impact assembly 450 and/or flexible assembly 400 may include apertures and protrusions for receiving a pitching machine).

When a moving object 700 such as a ball is moved toward and strikes layer 460, the exemplary disclosed layered structure (for example as illustrated in FIG. 17A or FIG. 17B) may be pushed toward layer 455 by the object's impact. The object may then push impact assembly 450 into flexible assembly 400, which may compress flexible assembly 400 against structural assembly 350. The object may push impact assembly 450 into flexible assembly 400 until the kinetic energy of the moving object has been transferred into potential energy of compressed flexible assembly 400. The object then stops advancing toward structural assembly 350 and drops to the ground. Flexible assembly 400 may thereby operate to deaden an impact of the moving object and prevent the object such as a ball from hitting a surface (e.g., indoor surface) and ricocheting back at a user or other individuals located near system 300.

As illustrated in FIGS. 8 and 17A (e.g., and FIG. 17B), structural assembly 350, flexible assembly 400, and impact assembly 450 may form a barrier screen 600. Barrier screen 600 may include a first barrier screen portion 605, which may be formed by lower portion 320, lower portion 420, and lower portion 470. Barrier screen 600 may also include a second barrier screen portion 610, which may be formed by upper portion 330, upper portion 430, and upper portion 480. First barrier screen portion 605 may be a cylinder section. Second barrier screen portion 610 may be an elliptical section or a spherical section (e.g., a dome section). First barrier screen portion 605 and second barrier screen portion 610 may be configured concave-inward relative to an object (e.g., object 700) that is moved toward barrier screen 600.

Imaging system 500 may provide (e.g., project) an image such as pictures, videos, or computer animation on a surface of impact assembly 450. For example, imaging system 500 may project a simulated environment such as a golf course, sports field, or other suitable environment to provide a realistic and immersive experience for a user.

Imaging system 500 may include a plurality of projectors 510. Projector 510 may be any suitable projector such as a laser projector. For example as illustrated in FIGS. 1, 2, 3, 4, 5, and 9, one or more projectors 510 (e.g., two projectors 510) may project a desired image on impact assembly 450 to display an immersive environment for a user located on an activity platform 520. For example, the field of view (e.g., angle of view) for a user (e.g., training athlete) located on activity platform 520 may be substantially filled with images projected by one or more projectors 510. Based on the exemplary disclosed horizontal and vertical curvature of system 300 described for example above, the projected image displayed for example on the lower portion 470 and upper portion 480 may appear more realistic as compared to projections on a flat screen. For example, the exemplary disclosed horizontal curvature of the exemplary disclosed bottom portion and horizontal and vertical curvature of the exemplary disclosed upper portion (e.g., forming an elliptical dome or a spherical dome) may provide an immersive experience in displaying the projected images.

Figure 5:
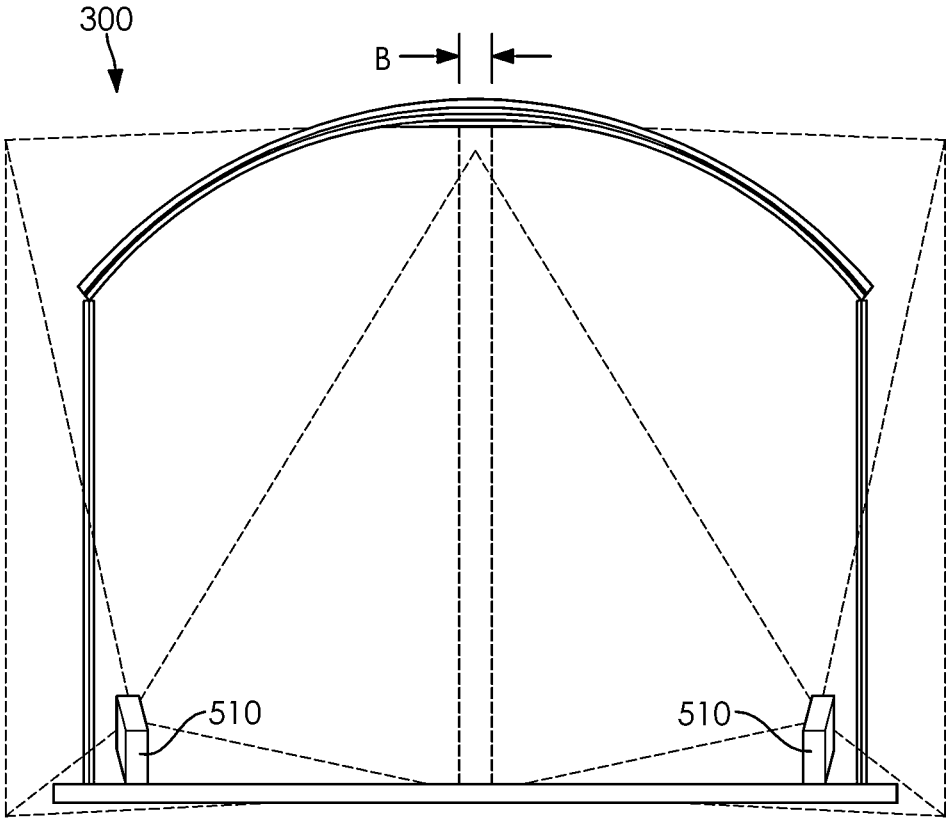
FIG. 5 illustrates a front view of at least some exemplary embodiments of the present disclosure.
Figure 9:
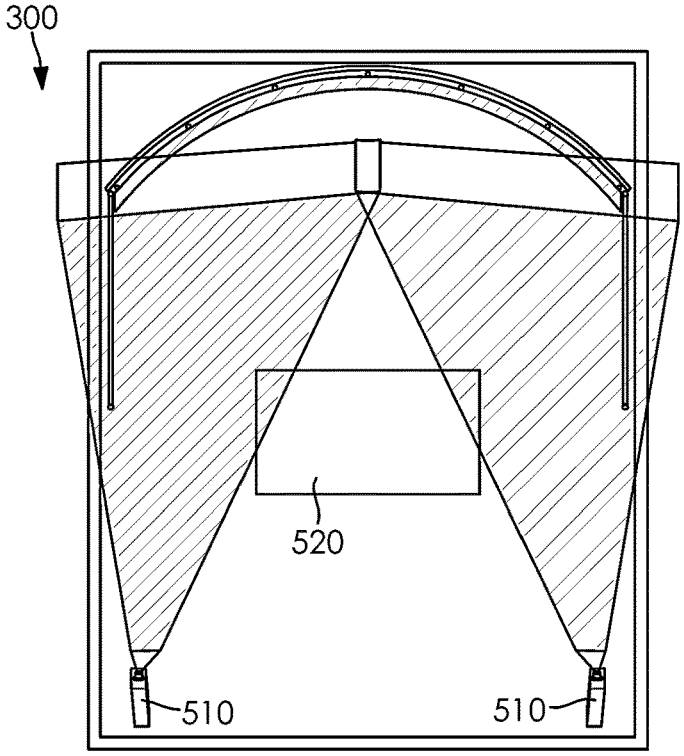
FIG. 9 illustrates a top view of at least some exemplary embodiments of the present disclosure.
Figure 14:
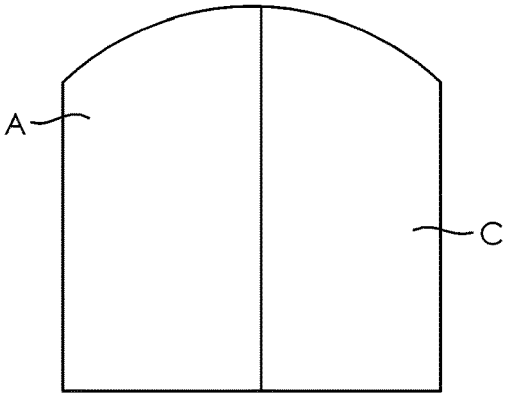
FIG. 14 illustrates a schematic view of at least some exemplary embodiments of the present disclosure.
Figure 15A:
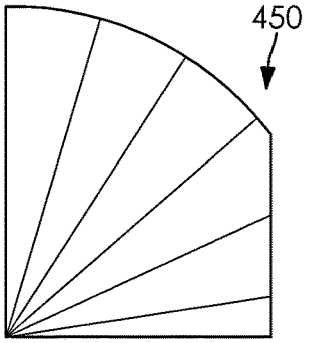
FIG. 15A illustrates a top view of at least some exemplary embodiments of the present disclosure.
Figure 15B:
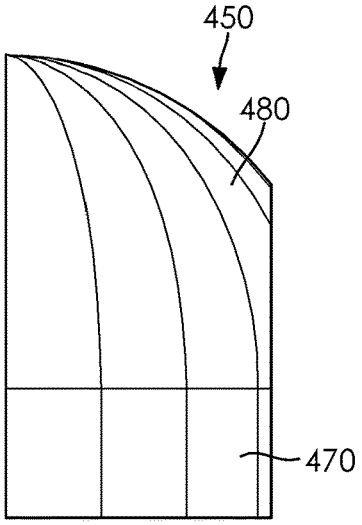
FIG. 15B illustrates a side view of at least some exemplary embodiments of the present disclosure.
Figure 15C:
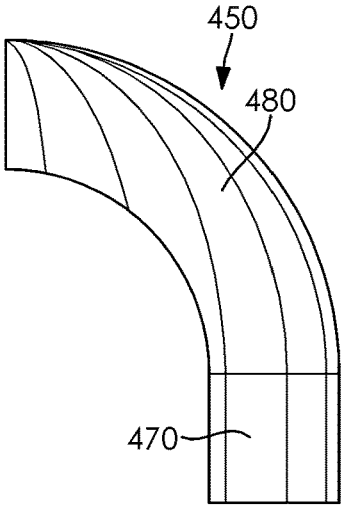
FIG. 15C illustrates a side view of at least some exemplary embodiments of the present disclosure.
Figure 15D:
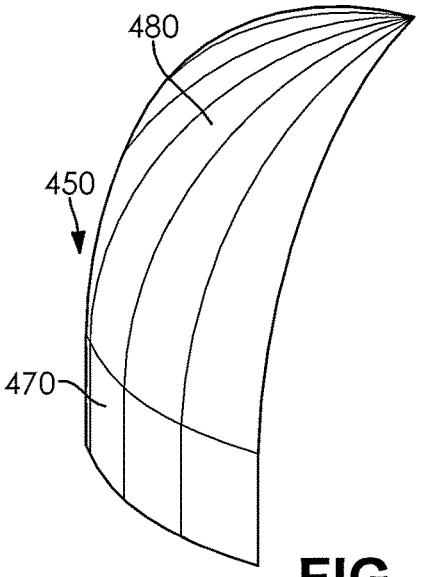
FIG. 15D illustrates a perspective view of at least some exemplary embodiments of the present disclosure.

For example as illustrated in FIGS. 1, 2, 5, 9, 10, and 14, a plurality of projectors 510 may each provide a projection (e.g., a projection channel) independently of each other and may provide an area of overlapping projection (e.g., a blend zone "B" as illustrated in FIG. 5) to provide for a relatively seamless projection for viewing by a user. Using a plurality of projectors 510 may also reduce an area of activity platform 520 that may potentially block projected images (e.g., a user may stand or move across most portions of activity platform 520 without blocking images projected by projectors 510). FIG. 9 illustrates a top view of a projection of an image on impact assembly 450 by projectors 510. FIG. 10 illustrates a front view of an active screen area "A" projected by one projector 510 on impact assembly 450. FIG. 14 illustrates a front view of active screen area "A" projected by a first projector 510 on impact assembly 450 and an active screen area "C" projected by a second projector 510.

Figure 18A:
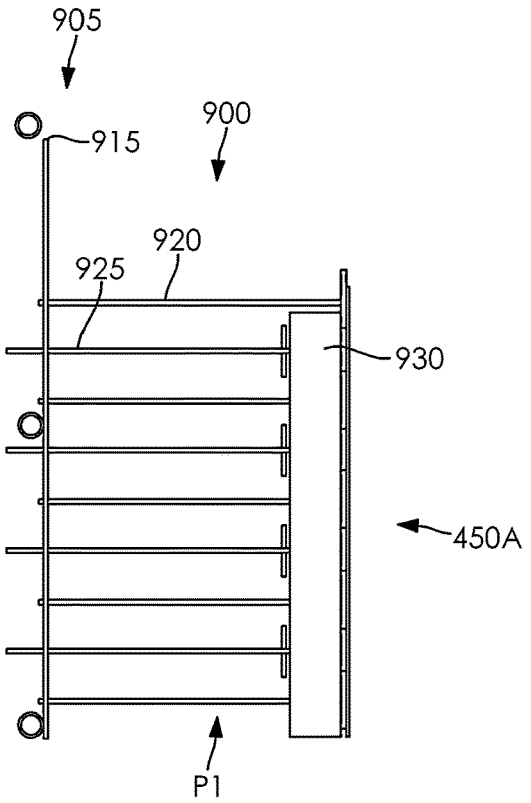
FIG. 18A illustrates a sectional view of at least some exemplary embodiments of the present disclosure.
Figure 18B:
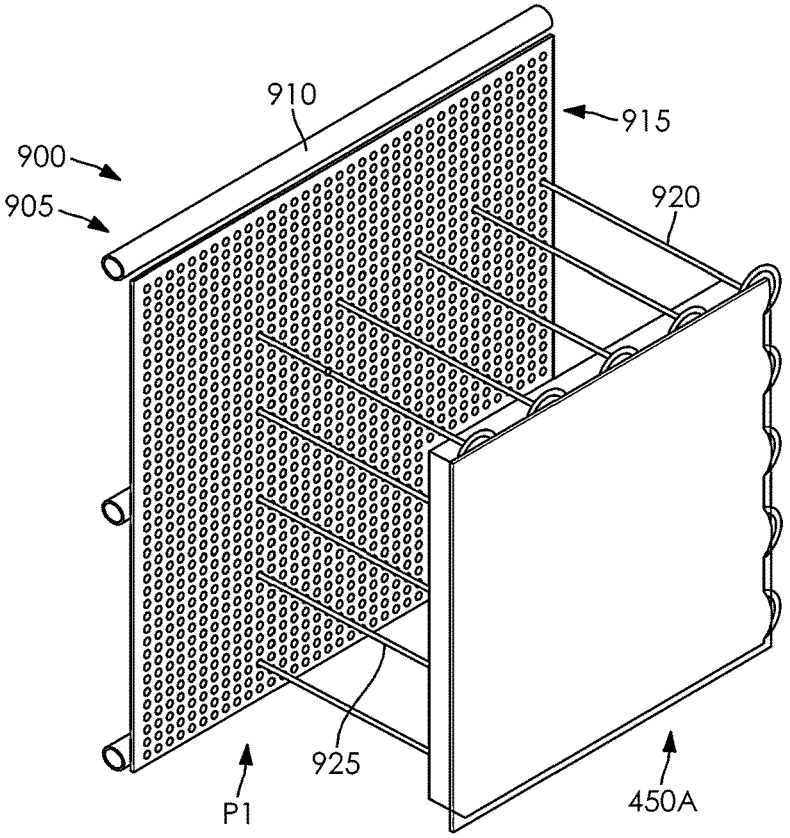
FIG. 18B illustrates a perspective view of at least some exemplary embodiments of the present disclosure.

FIGS. 18A and 18B illustrate another exemplary embodiment of the exemplary disclosed system, method, and apparatus. System 900 may include a support assembly 905 including a plurality of members 910. Members 910 may be any suitable structural members and may be formed from material generally similar to members of structural assembly 350. For example, members 910 may be round bars (e.g., 1" round bars). Support assembly 905 may support a support member 915. Support member 915 may be a sheet support member such as, for example, a perforated metal sheet including a plurality of apertures (e.g., round holes). Support assembly 905 may be attached to and/or may be an integral portion of support assembly 350. Support assembly 905 may support a flexible assembly that may be similar to flexible assembly 400, and an impact assembly 450A that may be similar to impact assembly 450, for example as described below.

As illustrated in FIGS. 18A and 18B, system 900 may include a plurality of elongated members 920 and a plurality of elongated members 925. Elongated members 920 may support impact assembly 450A by applying a tension force to impact assembly 450A. For example, elongated members 920 may form a tension assembly for supporting impact assembly 450A. Elongated members 925 may support a fiber member 930 that may be disposed behind impact assembly 450A as illustrated in FIGS. 18A and 18B. Fiber member 930 may be formed from a fibrous material such as a reinforced fibrous material (e.g., may be a 2" thick reinforced fibrous member). Fiber member 930 may be formed for example from a fiber-reinforced composite material, a fiber reinforced polymer material, and/or any other suitable fiber material. Elongated members 920 and 925 may be disposed in an alternating pattern with respect to each other for example as illustrated in FIG. 18A, and may be supported by support member 915 by being inserted through apertures of support member 915. The flexible assembly that may be similar to flexible assembly 400 may be supported in a space P1 disposed between support member 915 and fiber member 930. For example, a plurality of elongated members (e.g., elongated members 920 and 925) may be attached to a fabric layer (e.g., impact assembly 450A) and to a perforated plate member (e.g., support member 915) that may be attached to a portion of structural assembly 350.

FIGS. 19A, 19B, 19C, and 19D illustrate exemplary embodiments of elongated members 920 and 925. Elongated members 920 and 925 may include rods such as rods 935 and washers such as washers 940 and may be formed from nylon material and/or any other suitable material. Some of washers 940 may be adhered (e.g., glued) and/or sewn to a back surface of impact assembly 450A. Some or all washers 940 may include a slit 945 cut to a full radius of the washer. Rod 935 may be integrally formed with washer 940 (e.g., or attached to washer 940). Washer 940 may include a fastener 950. Fastener 950 may fasten washer 940 to other components of system 900 such as, for example, impact assembly 450A and fiber member 930. Fastener 950 may be a patch, a pocket, a loop, a hook, or any other suitable fastener.

Returning to FIG. 1, computing system 550 may control an operation of system 300, including controlling an operation of projectors 510. Computing system 550 may include a computing device. Computing system 550 may communicate with any suitable components of system 300 wirelessly (e.g., via network component 555) and/or via direct communication. Computing system 550 may include any suitable computing and/or controller components (e.g., a computing device) for controlling an operation of system 300. The computing and/or controller components may include for example a micro-processing logic control device or board components. Also for example, the computing and/or controller components may include input/output arrangements that allow them to be connected (e.g., via wireless and/or electrical connection) to other components of system 300. For example, computing system 550 and/or any suitable component of system 300 may communicate via any suitable communication method such as, for example, wireless communication (e.g., CDMA, GSM, 3G, 4G, and/or 5G), direct communication (e.g., wire communication), Bluetooth communication coverage, Near Field Communication (e.g., NFC contactless communication), radio frequency communication (e.g., RF communication such as short-wavelength radio waves, e.g., UHF waves), and/or any other desired communication technique. Components of computing system 550 may be integrated into any suitable components of system 300.

Computing system 550 may include one or more modules that may be partially or substantially entirely integrated with any suitable components of system 300 such as, for example, network component 555, a user device 560, and/or any other suitable component of system 300. The one or more modules may be software modules as described for example below regarding FIG. 20. For example, the one or more modules may include computer-executable code stored in non-volatile memory. The one or more modules may also operate using a processor (e.g., as described for example herein). The one or more modules may store data and/or be used to control some or all of the exemplary disclosed processes described herein. The one or more modules may operate using machine learning and artificial intelligence operations for example as described herein.

Figure 16:
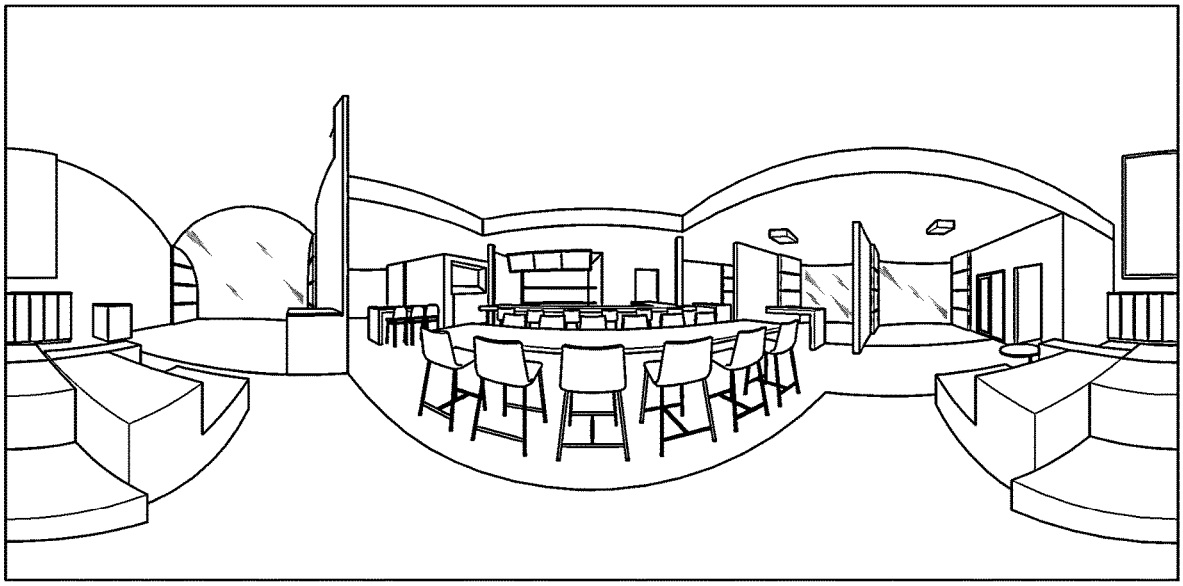
FIG. 16 illustrates a panoramic projection view of at least some exemplary embodiments of the present disclosure.

Computing system 550 may provide for projection mapping of an object such as a ball used with system 300. For example, a user using system 300 may hit, throw, or kick a ball at impact assembly 450. As the physical ball is stopped by impact assembly 450 and flexible assembly 400 and drops to the ground for example as described above, computing system 550 may provide for projection mapping of the ball on the display projected by projectors 510 on a surface of impact assembly 450. Computing system 550 may use any suitable techniques for use in projection mapping such as, for example, using one or more sensors 800 to gather data on the physical dynamics and interaction between a user (e.g., located on activity platform 520) and the ball, desired ambient conditions (e.g., wind speed, humidity, or turf firmness), and/or any other desired factors. For example when system 300 provides a golf simulation to a user who is a golfer (e.g., and activity platform 520 is a golf platform), system 300 may include one or more sensors 800 (e.g., an infrared sensor, cameras, and/or any other suitable sensor) that collect data for use by computing system 550 in calculating a trajectory of the ball to display via projectors 510. For example based on the actual physical mechanics of a golf swing and golf ball movement, computing system 550 may calculate and project a trajectory on impact assembly 450 that a golf ball would have taken had it not been stopped by flexible assembly 400. FIG. 16 illustrates an exemplary embodiment of the exemplary disclosed system that may be a golf simulation system included in an athletic facility.

Computing system 550 may also operate to adjust and refine a resolution and appearance of images projected by projectors 510 on the exemplary disclosed curved surfaces of impact assembly 450. For example, the exemplary disclosed modules of computing system 550 may adjust the appearance of the projected images based on the actual physical horizontal and vertical curvature of impact assembly 450, flexible assembly 400, and structural assembly 350 (for example, the exemplary disclosed curvature described above).

User device 560 may be any suitable user device for receiving input and/or providing output (e.g., raw data or other desired information) to a user. User device 560 may be, for example, a touchscreen device (e.g., a smartphone, a tablet, a smartboard, and/or any suitable computer device), a computer keyboard and monitor (e.g., desktop or laptop), an audio-based device for entering input and/or receiving output via sound, a tactile-based device for entering input and receiving output based on touch or feel, a dedicated user device or interface designed to work specifically with other components of the exemplary disclosed system, and/or any other suitable user device or interface. For example, user device 560 may include a touchscreen device of a smartphone or handheld tablet. For example, user device 560 may include a display that may include a graphical user interface to facilitate entry of input by a user and/or receiving output. For example, the exemplary disclosed system may provide notifications to a user via output transmitted to the exemplary disclosed user device. User device 560 may also be any suitable accessory such as a smart watch, Bluetooth headphones, and/or other suitable devices that may communicate with components of the exemplary disclosed system. For example, user device 560 may include a plurality of applications that may be displayed on a screen or any other suitable graphical user interface of the exemplary disclosed user device. User device 560 may include components and/or operate with components similar to the exemplary disclosed components of FIGS. 20 and 21.

The exemplary disclosed system for creating a virtual environment may include a barrier screen configured to stop an object including a ball that is moved toward the barrier, including a first barrier screen portion that is a cylinder section, and a second barrier screen portion that is disposed above the first barrier screen portion, wherein the second barrier screen portion is an elliptical section. The exemplary disclosed system may also include at least one projector configured to project an image of the virtual environment on the barrier screen, at least one sensor configured to sense data associated with the object, and a computing device configured to control the at least one projector to change the image based on the sensed data. The first barrier screen portion may be horizontally curved about a vertical axis. The second barrier screen may be both horizontally curved about a vertical axis and vertically curved about a horizontal axis. The first barrier screen portion may be between four feet high and six feet high. The first barrier screen portion and the second barrier screen portion may each include a foam layer. The first barrier screen portion may each include a fabric layer forming both an impact surface for the object and a display surface for the image. The first barrier screen portion and the second barrier screen portion may each include a portion of a structural assembly that structurally supports the barrier screen. The structural assembly may be a geodesic assembly formed from structural steel tubing. The first barrier screen portion and the second barrier screen portion may each include a portion of a structural assembly that structurally supports the barrier screen, a fabric layer that is attached freely-hanging to the structural assembly, the fabric layer forming both an impact surface for the object and a display surface for the image, and a compressible layer disposed between the fabric layer and the structural assembly. The exemplary disclosed system may further include a plurality of elongated members that are attached to the fabric layer and to a perforated plate member that is attached to the portion of the structural assembly. The first barrier screen portion and the second barrier screen portion may be configured concave-inward relative to the object that is moved toward the barrier screen.

The exemplary disclosed method may include assembling a barrier screen having a first barrier screen portion and a second barrier screen portion that is disposed above the first barrier screen portion, assembling the first barrier screen portion as a cylindrical section, and assembling the second barrier screen portion as an elliptical section. The exemplary disclosed method may also include stopping an object including a ball that is propelled toward the barrier screen with a surface of the barrier screen, sensing data associated with the object that is propelled, and projecting an image on the surface of the barrier screen showing a continued virtual path of the object based on the sensed data. Assembling the first barrier screen portion and the second barrier screen portion may include removably assembling a structural modular assembly. The exemplary disclosed method may also include disassembling the structural modular assembly and subsequently removably assembling the structural modular assembly. Assembling the first barrier screen portion and the second barrier screen portion may include removably attaching a freely hanging fabric layer to the barrier screen at a plurality of attachment points, the freely hanging fabric layer including a first portion cylindrically shaped to fit in the first barrier screen portion, and a second portion elliptically shaped to fit in the second barrier screen portion. The exemplary disclosed method may further include supporting a foam layer with the freely hanging fabric layer. The freely hanging fabric layer may include a base layer and a removably attachable sacrificial layer disposed in front of the base layer. Removably attaching the freely hanging fabric layer to the barrier screen at the plurality of attachment points may include attaching the freely hanging fabric layer, using a plurality of rods, to a portion of a structural assembly that structurally supports the barrier screen. Stopping the object that is propelled toward the barrier screen with the surface of the barrier screen may include compressing a foam layer disposed behind a fabric layer that forms the surface of the barrier screen.

The exemplary disclosed system for creating a virtual environment may include a barrier screen configured to stop an object including a ball that is moved toward the barrier screen, including a first barrier screen portion that is horizontally curved about a vertical axis, and a second barrier screen portion that is disposed above the first barrier screen portion, wherein the second barrier screen portion is both horizontally curved about a vertical axis and vertically curved about a horizontal axis. The exemplary disclosed system may also include at least one projector configured to project an image of the virtual environment on the barrier screen, at least one sensor configured to sense data associated with the object, and a computing device configured to control the at least one projector to change the image based on the sensed data. The first barrier screen portion and the second barrier screen portion may each include a portion of a structural assembly that structurally supports the barrier screen, a fabric layer that is attached freely-hanging to the structural assembly, the fabric layer forming both an impact surface for the object and a display surface for the image, and a foam layer disposed between the fabric layer and the structural assembly. The foam layer may be between 6 inches thick and 18 inches thick. The fabric layer may include two layers that are attached together at a perimeter of the fabric layer via fasteners that are received through apertures disposed at the perimeter of the fabric layer.

The exemplary disclosed system, method, and apparatus may be used in any suitable application such as, for example, physical training. The exemplary disclosed system, method, and apparatus may be used in any suitable application for sports training. The exemplary disclosed system, method, and apparatus may be used in any suitable application involving a moving object such as a ball used in playing a sport. The exemplary disclosed system, method, and apparatus may be used in training for athletic sports such as golf, baseball, football, skee ball, bowling, soccer, kickball, dodgeball, tennis, or any other suitable sport. The exemplary disclosed system, method, and apparatus may also be used in any suitable application such as military training or law enforcement training or any other suitable type of physical activity.

The exemplary disclosed system, method, and apparatus may provide an efficient and effective technique for helping a user to improve physical skills such as enhancing ability in a sport. The exemplary disclosed system, method, and apparatus may assist a user in enhancing performance in a sport by providing a realistic simulation of athletic activities such as interacting with a ball used in a sport. The exemplary disclosed system, method, and apparatus may provide a realistic simulation of an outdoor (e.g., or indoor) sporting activity in an indoor setting such as, for example, hitting a golf ball with a golf club, hitting a baseball with a baseball bat, throwing a football to a simulated receiver, or any other desired activity. The exemplary disclosed system, method, and apparatus may facilitate a realistic simulation (e.g., a realistic projection of a virtual environment) and/or immersive experience to a user who may interact with an actual play object (e.g., ball) in connection with the realistic simulation. The exemplary disclosed system, method, and apparatus may thereby provide a realistic environment for improving athletic or physical performance of a user.

Figure 20:
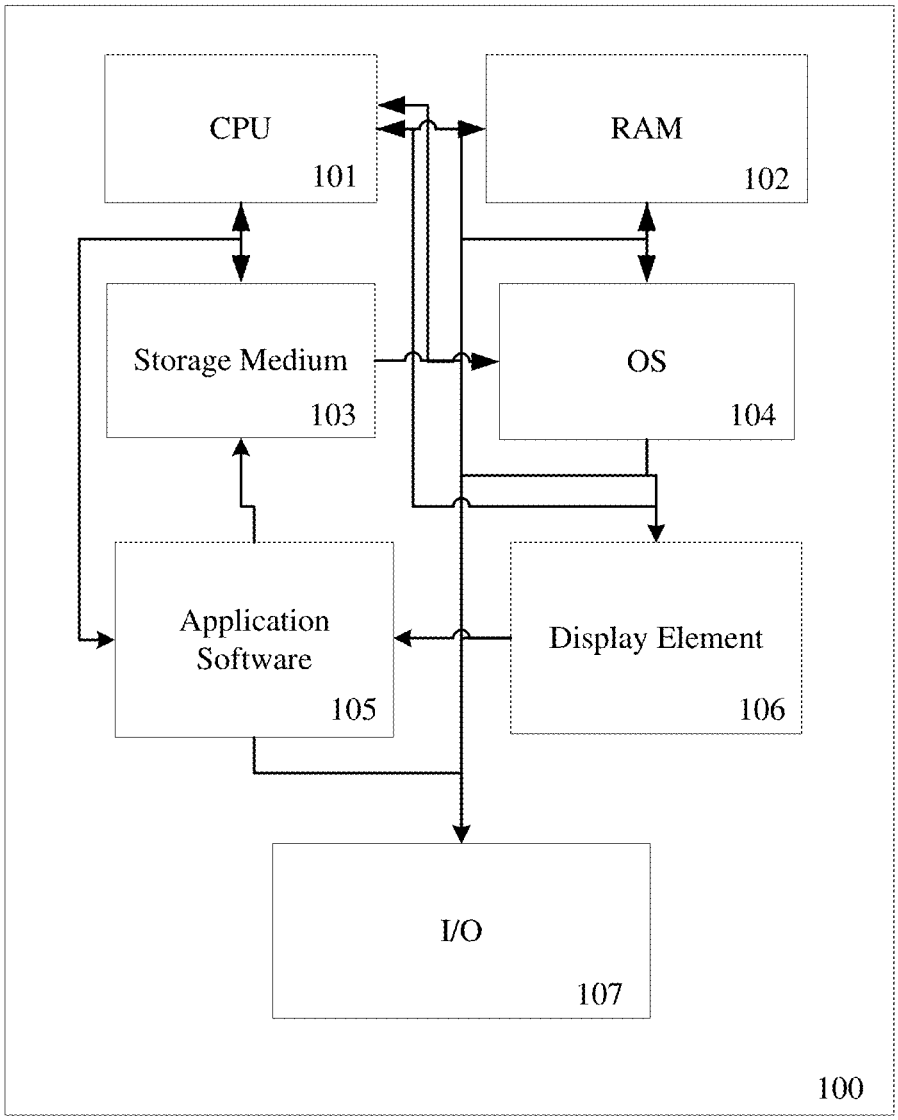
FIG. 20 is a schematic illustration of an exemplary computing device, in accordance with at least some exemplary embodiments of the present disclosure.

An illustrative representation of a computing device appropriate for use with embodiments of the system of the present disclosure is shown in FIG. 20. The computing device 100 can generally be comprised of a Central Processing Unit (CPU, 101), optional further processing units including a graphics processing unit (GPU), a Random Access Memory (RAM, 102), a mother board 103, or alternatively/additionally a storage medium (e.g., hard disk drive, solid state drive, flash memory, cloud storage), an operating system (OS, 104), one or more application software 105, a display element 106, and one or more input/output devices/means 107, including one or more communication interfaces (e.g., RS232, Ethernet, Wifi, Bluetooth, USB). Useful examples include, but are not limited to, personal computers, smart phones, laptops, mobile computing devices, tablet PCs, and servers. Multiple computing devices can be operably linked to form a computer network in a manner as to distribute and share one or more resources, such as clustered computing devices and server banks/farms.

Various examples of such general-purpose multi-unit computer networks suitable for embodiments of the disclosure, their typical configuration and many standardized communication links are well known to one skilled in the art, as explained in more detail and illustrated by FIG. 21, which is discussed herein-below.

According to an exemplary embodiment of the present disclosure, data may be transferred to the system, stored by the system and/or transferred by the system to users of the system across local area networks (LANs) (e.g., office networks, home networks) or wide area networks (WANs) (e.g., the Internet). In accordance with the previous embodiment, the system may be comprised of numerous servers communicatively connected across one or more LANs and/or WANs. One of ordinary skill in the art would appreciate that there are numerous manners in which the system could be configured and embodiments of the present disclosure are contemplated for use with any configuration.

In general, the system and methods provided herein may be employed by a user of a computing device whether connected to a network or not. Similarly, some steps of the methods provided herein may be performed by components and modules of the system whether connected or not. While such components/modules are offline, and the data they generated will then be transmitted to the relevant other parts of the system once the offline component/module comes again online with the rest of the network (or a relevant part thereof). According to an embodiment of the present disclosure, some of the applications of the present disclosure may not be accessible when not connected to a network, however a user or a module/component of the system itself may be able to compose data offline from the remainder of the system that will be consumed by the system or its other components when the user/offline system component or module is later connected to the system network.

Figure 21:
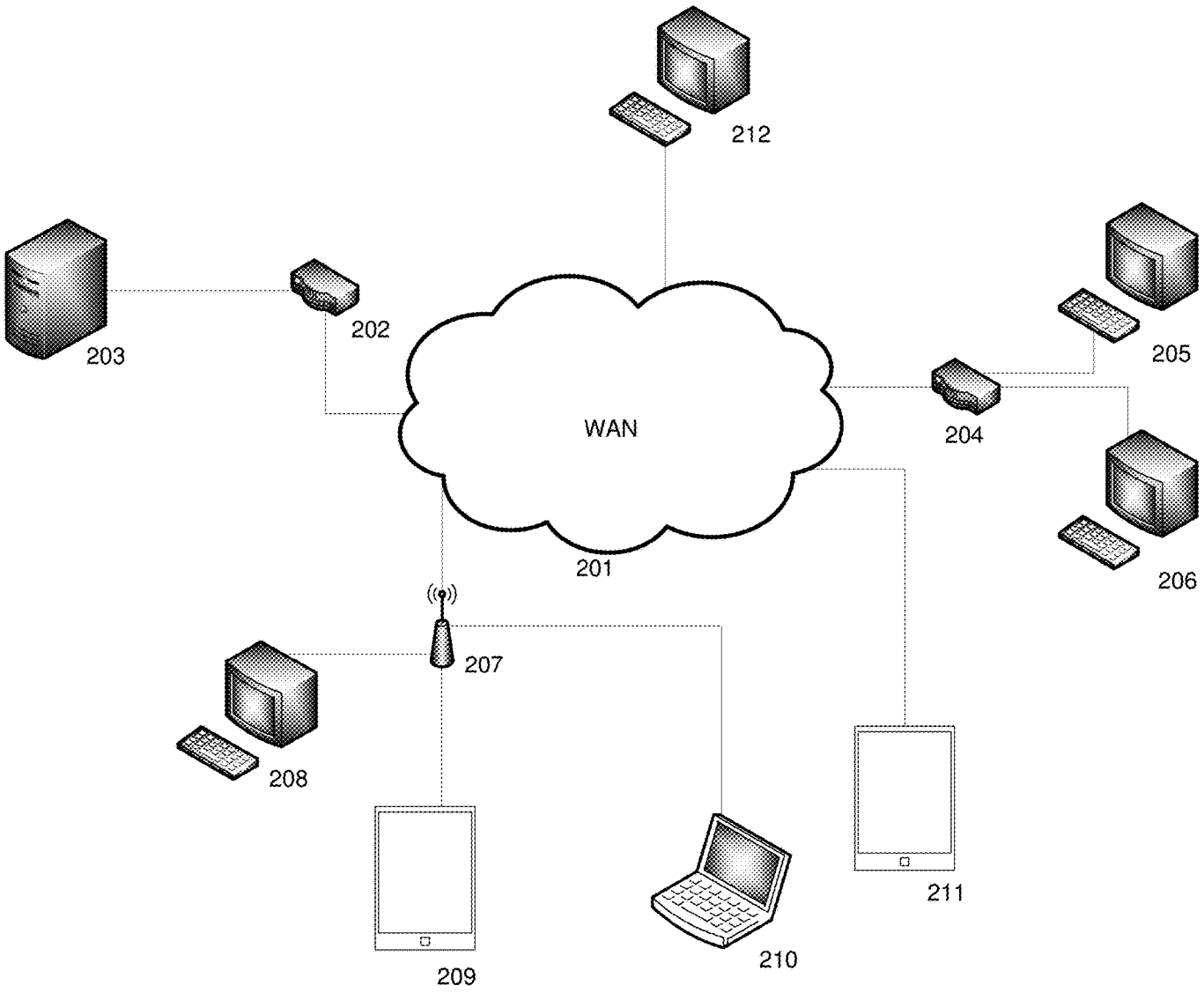
FIG. 21 is a schematic illustration of an exemplary network, in accordance with at least some exemplary embodiments of the present disclosure.

Referring to FIG. 21, a schematic overview of a system in accordance with an embodiment of the present disclosure is shown. The system is comprised of one or more application servers 203 for electronically storing information used by the system. Applications in the server 203 may retrieve and manipulate information in storage devices and exchange information through a WAN 201 (e.g., the Internet). Applications in server 203 may also be used to manipulate information stored remotely and process and analyze data stored remotely across a WAN 201 (e.g., the Internet).

According to an exemplary embodiment, as shown in FIG. 21, exchange of information through the WAN 201 or other network may occur through one or more high speed connections. In some cases, high speed connections may be over-the-air (OTA), passed through networked systems, directly connected to one or more WANs 201 or directed through one or more routers 202. Router(s) 202 are completely optional and other embodiments in accordance with the present disclosure may or may not utilize one or more routers 202. One of ordinary skill in the art would appreciate that there are numerous ways server 203 may connect to WAN 201 for the exchange of information, and embodiments of the present disclosure are contemplated for use with any method for connecting to networks for the purpose of exchanging information. Further, while this application refers to high speed connections, embodiments of the present disclosure may be utilized with connections of any speed.

Components or modules of the system may connect to server 203 via WAN 201 or other network in numerous ways. For instance, a component or module may connect to the system i) through a computing device 212 directly connected to the WAN 201, ii) through a computing device 205, 206 connected to the WAN 201 through a routing device 204, iii) through a computing device 208, 209, 210 connected to a wireless access point 207 or iv) through a computing device 211 via a wireless connection (e.g., CDMA, GMS, 3G, 4G, 5G) to the WAN 201. One of ordinary skill in the art will appreciate that there are numerous ways that a component or module may connect to server 203 via WAN 201 or other network, and embodiments of the present disclosure are contemplated for use with any method for connecting to server 203 via WAN 201 or other network. Furthermore, server 203 could be comprised of a personal computing device, such as a smartphone, acting as a host for other computing devices to connect to.

The communications means of the system may be any means for communicating data, including image and video, over one or more networks or to one or more peripheral devices attached to the system, or to a system module or component. Appropriate communications means may include, but are not limited to, wireless connections, wired connections, cellular connections, data port connections, Bluetooth® connections, near field communications (NFC) connections, or any combination thereof. One of ordinary skill in the art will appreciate that there are numerous communications means that may be utilized with embodiments of the present disclosure, and embodiments of the present disclosure are contemplated for use with any communications means.

Traditionally, a computer program includes a finite sequence of computational instructions or program instructions. It will be appreciated that a programmable apparatus or computing device can receive such a computer program and, by processing the computational instructions thereof, produce a technical effect.

A programmable apparatus or computing device includes one or more microprocessors, microcontrollers, embedded microcontrollers, programmable digital signal processors, programmable devices, programmable gate arrays, programmable array logic, memory devices, application specific integrated circuits, or the like, which can be suitably employed or configured to process computer program instructions, execute computer logic, store computer data, and so on. Throughout this disclosure and elsewhere a computing device can include any and all suitable combinations of at least one general purpose computer, special-purpose computer, programmable data processing apparatus, processor, processor architecture, and so on. It will be understood that a computing device can include a computer-readable storage medium and that this medium may be internal or external, removable and replaceable, or fixed. It will also be understood that a computing device can include a Basic Input/Output System (BIOS), firmware, an operating system, a database, or the like that can include, interface with, or support the software and hardware described herein.

Embodiments of the system as described herein are not limited to applications involving conventional computer programs or programmable apparatuses that run them. It is contemplated, for example, that embodiments of the disclosure as claimed herein could include an optical computer, quantum computer, analog computer, or the like.

Regardless of the type of computer program or computing device involved, a computer program can be loaded onto a computing device to produce a particular machine that can perform any and all of the depicted functions. This particular machine (or networked configuration thereof) provides a technique for carrying out any and all of the depicted functions.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. Illustrative examples of the computer readable storage medium may include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A data store may be comprised of one or more of a database, file storage system, relational data storage system or any other data system or structure configured to store data. The data store may be a relational database, working in conjunction with a relational database management system (RDBMS) for receiving, processing and storing data. A data store may comprise one or more databases for storing information related to the processing of moving information and estimate information as well one or more databases configured for storage and retrieval of moving information and estimate information.

Computer program instructions can be stored in a computer-readable memory capable of directing a computer or other programmable data processing apparatus to function in a particular manner. The instructions stored in the computer-readable memory constitute an article of manufacture including computer-readable instructions for implementing any and all of the depicted functions.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

The elements depicted in flowchart illustrations and block diagrams throughout the figures imply logical boundaries between the elements. However, according to software or hardware engineering practices, the depicted elements and the functions thereof may be implemented as parts of a monolithic software structure, as standalone software components or modules, or as components or modules that employ external routines, code, services, and so forth, or any combination of these. All such implementations are within the scope of the present disclosure. In view of the foregoing, it will be appreciated that elements of the block diagrams and flowchart illustrations support combinations of means for performing the specified functions, combinations of steps for performing the specified functions, program instruction technique for performing the specified functions, and so on.

It will be appreciated that computer program instructions may include computer executable code. A variety of languages for expressing computer program instructions are possible, including without limitation C, C++, Java, JavaScript, assembly language, Lisp, HTML, Perl, and so on. Such languages may include assembly languages, hardware description languages, database programming languages, functional programming languages, imperative programming languages, and so on. In some embodiments, computer program instructions can be stored, compiled, or interpreted to run on a computing device, a programmable data processing apparatus, a heterogeneous combination of processors or processor architectures, and so on. Without limitation, embodiments of the system as described herein can take the form of web-based computer software, which includes client/server software, software-as-a-service, peer-to-peer software, or the like.

In some embodiments, a computing device enables execution of computer program instructions including multiple programs or threads. The multiple programs or threads may be processed more or less simultaneously to enhance utilization of the processor and to facilitate substantially simultaneous functions. By way of implementation, any and all methods, program codes, program instructions, and the like described herein may be implemented in one or more thread. The thread can spawn other threads, which can themselves have assigned priorities associated with them. In some embodiments, a computing device can process these threads based on priority or any other order based on instructions provided in the program code.

Unless explicitly stated or otherwise clear from the context, the verbs "process" and "execute" are used interchangeably to indicate execute, process, interpret, compile, assemble, link, load, any and all combinations of the foregoing, or the like. Therefore, embodiments that process computer program instructions, computer-executable code, or the like can suitably act upon the instructions or code in any and all of the ways just described.

The functions and operations presented herein are not inherently related to any particular computing device or other apparatus. Various general-purpose systems may also be used with programs in accordance with the teachings herein, or it may prove convenient to construct more specialized apparatus to perform the required method steps. The required structure for a variety of these systems will be apparent to those of ordinary skill in the art, along with equivalent variations. In addition, embodiments of the disclosure are not described with reference to any particular programming language. It is appreciated that a variety of programming languages may be used to implement the present teachings as described herein, and any references to specific languages are provided for disclosure of enablement and best mode of embodiments of the disclosure. Embodiments of the disclosure are well suited to a wide variety of computer network systems over numerous topologies. Within this field, the configuration and management of large networks include storage devices and computing devices that are communicatively coupled to dissimilar computing and storage devices over a network, such as the Internet, also referred to as "web" or "world wide web".

In at least some exemplary embodiments, the exemplary disclosed system may utilize sophisticated machine learning and/or artificial intelligence techniques to prepare and submit datasets and variables to cloud computing clusters and/or other analytical tools (e.g., predictive analytical tools) which may analyze such data using artificial intelligence neural networks. The exemplary disclosed system may for example include cloud computing clusters performing predictive analysis. For example, the exemplary neural network may include a plurality of input nodes that may be interconnected and/or networked with a plurality of additional and/or other processing nodes to determine a predicted result. Exemplary artificial intelligence processes may include filtering and processing datasets, processing to simplify datasets by statistically eliminating irrelevant, invariant or superfluous variables or creating new variables which are an amalgamation of a set of underlying variables, and/or processing for splitting datasets into train, test and validate datasets using at least a stratified sampling technique. The exemplary disclosed system may utilize prediction algorithms and approach that may include regression models, tree-based approaches, logistic regression, Bayesian methods, deep-learning and neural networks both as a standalone and on an ensemble basis, and final prediction may be based on the model/structure which delivers the highest degree of accuracy and stability as judged by implementation against the test and validate datasets.

Throughout this disclosure and elsewhere, block diagrams and flowchart illustrations depict methods, apparatuses (e.g., systems), and computer program products. Each element of the block diagrams and flowchart illustrations, as well as each respective combination of elements in the block diagrams and flowchart illustrations, illustrates a function of the methods, apparatuses, and computer program products. Any and all such functions ("depicted functions") can be implemented by computer program instructions; by special-purpose, hardware-based computer systems; by combinations of special purpose hardware and computer instructions; by combinations of general purpose hardware and computer instructions; and so on—any and all of which may be generally referred to herein as a "component", "module," or "system."

While the foregoing drawings and description set forth functional aspects of the disclosed systems, no particular arrangement of software for implementing these functional aspects should be inferred from these descriptions unless explicitly stated or otherwise clear from the context.

Each element in flowchart illustrations may depict a step, or group of steps, of a computer-implemented method. Further, each step may contain one or more sub-steps. For the purpose of illustration, these steps (as well as any and all other steps identified and described above) are presented in order. It will be understood that an embodiment can contain an alternate order of the steps adapted to a particular application of a technique disclosed herein. All such variations and modifications are intended to fall within the scope of this disclosure. The depiction and description of steps in any particular order is not intended to exclude embodiments having the steps in a different order, unless required by a particular application, explicitly stated, or otherwise clear from the context.

The functions, systems and methods herein described could be utilized and presented in a multitude of languages. Individual systems may be presented in one or more languages and the language may be changed with ease at any point in the process or methods described above. One of ordinary skill in the art would appreciate that there are numerous languages the system could be provided in, and embodiments of the present disclosure are contemplated for use with any language.

While multiple embodiments are disclosed, still other embodiments of the present disclosure will become apparent to those skilled in the art from this detailed description. There may be aspects of this disclosure that may be practiced without the implementation of some features as they are described. It should be understood that some details have not been described in detail in order to not unnecessarily obscure the focus of the disclosure. The disclosure is capable of myriad modifications in various obvious aspects, all without departing from the spirit and scope of the present disclosure. Accordingly, the drawings and descriptions are to be regarded as illustrative rather than restrictive in nature.

What is claimed is:

1. A system for creating a virtual environment, comprising:

a barrier screen configured to stop an object including a ball that is moved toward the barrier screen over a ground surface, including a first barrier screen portion that is a cylinder section extending from the ground surface, and a second barrier screen portion that is disposed above the first barrier screen portion, wherein the second barrier screen portion is an elliptical section;

at least one projector configured to project an image of the virtual environment on the barrier screen;

at least one sensor configured to sense data associated with the object; and a computing device configured to control the at least one projector to change the image based on the sensed data;

wherein the first barrier screen portion is horizontally curved about a vertical axis and is without vertical curvature; and wherein the first barrier screen portion is between three feet high and twelve feet high measured from the ground surface.

2. The system of claim 1, wherein the first barrier screen portion is horizontally curved about a vertical axis and is without vertical curvature.

3. The system of claim 1, wherein the second barrier screen is both horizontally curved about a vertical axis and vertically curved about a horizontal axis.

4. The system of claim 1, wherein the first barrier screen portion is between four feet high and six feet high measured from the ground surface.

5. The system of claim 1, wherein the first barrier screen portion and the second barrier screen portion each include a foam layer.

6. The system of claim 1, wherein the first barrier screen portion and the second barrier screen portion each include a fabric layer forming both an impact surface for the object and a display surface for the image.

7. The system of claim 1, wherein the first barrier screen portion and the second barrier screen portion each include a portion of a structural assembly that structurally supports the barrier screen.

8. The system of claim 7, wherein the structural assembly is a geodesic assembly formed from structural steel tubing.

9. The system of claim 1, wherein the first barrier screen portion and the second barrier screen portion each include:

a portion of a structural assembly that structurally supports the barrier screen;

a fabric layer that is attached freely-hanging to the structural assembly, the fabric layer forming both an impact surface for the object and a display surface for the image; and a compressible layer disposed between the fabric layer and the structural assembly.

10. The system of claim 9, further comprising a plurality of elongated members that are attached to the fabric layer and to a perforated plate member that is attached to the portion of the structural assembly.

11. The system of claim 1, wherein the first barrier screen portion and the second barrier screen portion are configured concave-inward relative to the object that is moved toward the barrier screen.

12. A method, comprising:

assembling a barrier screen having a first barrier screen portion and a second barrier screen portion that is disposed above the first barrier screen portion;

assembling the first barrier screen portion as a cylindrical section extending from a ground surface;

assembling the second barrier screen portion as an elliptical section;

stopping an object including a ball that is propelled over the ground surface toward the barrier screen using a surface of the barrier screen;

sensing data associated with the object that is propelled; and projecting an image on the surface of the barrier screen showing a continued virtual path of the object based on the sensed data;

wherein the first barrier screen portion is horizontally curved about a vertical axis and is without vertical curvature; and wherein the first barrier screen portion is between three feet high and twelve feet high measured from the ground surface.

13. The method of claim 12, wherein assembling the first barrier screen portion and the second barrier screen portion includes removably assembling a structural modular assembly.

14. The method of claim 12, wherein assembling the first barrier screen portion and the second barrier screen portion includes removably attaching a freely hanging fabric layer to the barrier screen at a plurality of attachment points, the freely hanging fabric layer including:

a first portion cylindrically shaped to fit in the first barrier screen portion; and a second portion elliptically shaped to fit in the second barrier screen portion.

15. The method of claim 14, further comprising supporting a foam layer with the freely hanging fabric layer.

16. The method of claim 14, wherein the freely hanging fabric layer includes a base layer and a removably attachable sacrificial layer disposed in front of the base layer.

17. The method of claim 14, wherein removably attaching the freely hanging fabric layer to the barrier screen at the plurality of attachment points includes attaching the freely hanging fabric layer, using a plurality of rods, to a portion of a structural assembly that structurally supports the barrier screen.

18. The method of claim 13, wherein stopping the object that is propelled toward the barrier screen with the surface of the barrier screen includes compressing a foam layer disposed behind a fabric layer that forms the surface of the barrier screen.

19. A system for creating a virtual environment, comprising:

a barrier screen configured to stop an object including a ball that is moved toward the barrier screen over a ground surface, including a first barrier screen portion that is horizontally curved about a vertical axis extending from the ground surface without vertical curvature, and a second barrier screen portion that is disposed above the first barrier screen portion, wherein the second barrier screen portion is both horizontally curved about a vertical axis and vertically curved about a horizontal axis;

at least one projector configured to project an image of the virtual environment on the barrier screen;

at least one sensor configured to sense data associated with the object; and a computing device configured to control the at least one projector to change the image based on the sensed data;

wherein the first barrier screen portion and the second barrier screen portion each include:

a portion of a structural assembly that structurally supports the barrier screen;

a fabric layer that is attached freely-hanging to the structural assembly, the fabric layer forming both an impact surface for the object and a display surface for the image; and a foam layer disposed between the fabric layer and the structural assembly;

wherein the first barrier screen portion is between three feet high and twelve feet high measured from the ground surface.

20. The system of claim 19, wherein the foam layer is between 6 inches thick and 18 inches thick.

21. The system of claim 19, wherein the fabric layer includes two layers that are attached together at a perimeter of the fabric layer via fasteners that are received through apertures disposed at the perimeter of the fabric layer.

22. The system of claim 1, wherein the first barrier screen portion extends vertically from the ground surface without vertical curvature.

* * * * *